US009625202B2

(12) United States Patent
Lopes et al.

(10) Patent No.: US 9,625,202 B2
(45) Date of Patent: Apr. 18, 2017

(54) DIRECT CONTACT ICEMAKER WITH FINNED AIR COOLING CAPACITY

(75) Inventors: Luiz Antonio D. Lopes, Peachtree City, GA (US); Lorraine J. Westlake, Eau Claire, MI (US)

(73) Assignee: Whirlpoo Corporation, Benton Harbor, MI (US)

( * ) Notice: Subject to any disclaimer, the term of this patent is extended or adjusted under 35 U.S.C. 154(b) by 325 days.

(21) Appl. No.: 13/038,441

(22) Filed: Mar. 2, 2011

(65) Prior Publication Data

US 2012/0222435 A1 Sep. 6, 2012

(51) Int. Cl.
*F25D 17/06* (2006.01)
*F25C 5/00* (2006.01)

(52) U.S. Cl.
CPC ..... *F25D 17/065* (2013.01); *F25C 5/005* (2013.01); *F25D 2317/067* (2013.01)

(58) Field of Classification Search
CPC .. F25C 5/005; F25C 2400/04; F25C 2400/10; F25C 5/182; F25D 2317/067; F25D 17/045; F25D 2317/062; F25D 2317/063; F25D 17/067
USPC ..... 62/66, 344, 340, 74, 407
See application file for complete search history.

(56) References Cited

U.S. PATENT DOCUMENTS 2,941,379 A 6/1960 Nelson
3,010,292 A 11/1961 Newberry
3,788,089 A 1/1974 Graves
3,803,862 A 4/1974 Schumacher
4,947,653 A 8/1990 Day et al.
6,093,312 A * 7/2000 Boulter ..... B67D 1/0009 210/109
6,145,320 A 11/2000 Kim
6,434,965 B1 8/2002 Hughes et al.
6,662,574 B2 12/2003 Loibl et al.
7,062,936 B2 6/2006 Rand et al.
7,216,499 B2 5/2007 Flinner et al.
7,266,972 B2 9/2007 Anselmino et al.
7,523,880 B2 * 4/2009 Lee ..... F25C 5/007 241/225
7,610,773 B2 11/2009 Rafalovich et al.
7,752,859 B2 7/2010 Lee et al.
7,757,511 B2 7/2010 Leclear et al.
2005/0183441 A1 * 8/2005 Lee ..... F25D 17/045 62/340
2006/0000231 A1 * 1/2006 Zhao ..... F25D 11/006 62/419
2006/0086092 A1 * 4/2006 Fay ..... F28B 1/06 60/685

(Continued)

*Primary Examiner* — Frantz Jules
*Assistant Examiner* — Martha Tadesse

(57) ABSTRACT

A refrigerator includes a direct contact ice making system in conjunction with a circulating coolant. The ice making system includes a cold air loop including a plurality of fins to cool ambient air adjacent the cold air loop in the ice making system. The cooled air is passed by a fan assembly through a supply duct into an ice storage container or compartment to cool the area within the ice storage compartment, thus preventing ice cubes in the compartment from melting. The ice making system also includes a return duct for directing warm air from the ice storage compartment to the cold air loop for re-cooling and recirculation. The cold air loop may generally be a heat exchange zone for cooling the ambient air.

15 Claims, 7 Drawing Sheets

(56) References Cited

U.S. PATENT DOCUMENTS

| | | | | |
|---|---|---|---|---|
| 2006/0086130 | A1* | 4/2006 | Anselmino | F25C 5/005 62/344 |
| 2006/0266068 | A1* | 11/2006 | Wetekamp | F25C 5/005 62/340 |
| 2008/0155993 | A1 | 7/2008 | Kuehl | |
| 2008/0155997 | A1 | 7/2008 | Leclear et al. | |
| 2009/0158768 | A1* | 6/2009 | Rafalovich | F25D 11/025 62/434 |
| 2009/0165491 | A1* | 7/2009 | Rafalovich | F25C 1/04 62/344 |
| 2009/0260370 | A1 | 10/2009 | Wu et al. | |
| 2009/0260371 | A1 | 10/2009 | Kuehl et al. | |
| 2009/0282844 | A1 | 11/2009 | Rafalovich et al. | |
| 2009/0293501 | A1 | 12/2009 | Kulkarni et al. | |
| 2009/0293508 | A1 | 12/2009 | Rafalovich et al. | |
| 2010/0064704 | A1 | 3/2010 | Feinauer et al. | |
| 2010/0147005 | A1 | 6/2010 | Watson et al. | |
| 2010/0180608 | A1 | 7/2010 | Shaha et al. | |
| 2010/0218519 | A1 | 9/2010 | Hall et al. | |
| 2010/0218542 | A1* | 9/2010 | McCollough | F25C 5/005 62/345 |
| 2010/0251748 | A1* | 10/2010 | Park | F25D 17/065 62/407 |
| 2010/0313594 | A1* | 12/2010 | Lee | F25C 1/00 62/340 |
| 2010/0326093 | A1* | 12/2010 | Watson | F25B 7/00 62/66 |
| 2011/0259035 | A1* | 10/2011 | Wang | F25D 23/04 62/344 |

* cited by examiner

DIRECT CONTACT ICEMAKER WITH FINNED AIR COOLING CAPACITY

FIELD OF THE INVENTION

The invention relates generally to the field of refrigerators. More specifically, but not exclusively, the present invention provides an apparatus and method for producing and directing cooled air to an ice storage compartment to prevent the formed ice in the compartment from melting before being used.

BACKGROUND OF THE INVENTION

Many refrigerators contain ice making compartments located within either a freezer or refrigerator compartment. Typically, the ice making compartments include at least an ice mold, a water supply, and an ice storage compartment or container. Water is added to the ice mold from the water supply. A cold air source provides cold air that is passed over the water and the ice mold to freeze the water, forming ice cubes. Typically, a heat exchanger cools the air. A coolant may be used in the heat exchanger. After warming, the coolant must pass through a condenser and evaporator to re-cool to be able to be used to cool down new air in the ice making compartment.

The frozen cubes are then dislodged from the molds and transferred into the storage compartment. Because of the proximity of the storage compartment to the ice mold, the cold air that is used to freeze the water in the mold is also used to maintain the temperature of the storage compartment to below freezing. The cold air simply passes over the ice mold and continues through an opening in the storage compartment to the container of the frozen, dislodged ice. Using cooled air to form the ice and to keep the frozen ice from melting consumes a rather large amount of energy, which is costly to the refrigerator owner. The condenser and evaporator require energy to re-cool the coolant used to cool the ice making compartment, and a high volume of air must be cooled to be able to both freeze the ice and keep the temperature of the storage compartment below freezing.

To reduce the amount of electricity a refrigerator uses, other methods of freezing ice have been utilized. One such method involves direct contact cooling to form ice. The ice mold is placed in direct contact with a portion of the coolant loop so that the coolant moving through the loop absorbs the heat from the water in the mold to form ice cubes. As the coolant is able to absorb more heat than cooled air passing over the ice molds, less energy is needed. Therefore the cost of forming ice in the mold is reduced.

However, because the icemaker does not include the use of cooled air to form ice, no cooled air is available to maintain the temperature of the ice storage compartment below freezing. The formed ice is exposed to above freezing temperatures, which can cause the ice to melt, negating the ice making process. Efforts have been made to include portions of the coolant loop within the ice storage compartment, but this has not been practical when the storage compartment is part of a door of the refrigerator.

Accordingly, there is a need in the art for an apparatus and method of producing and directing cooled air to the ice storage compartment of a refrigerator utilizing a direct contact ice making process. There is also a need in the art for a method of producing cooled air for maintaining the temperature of an ice storage compartment that is cost efficient.

SUMMARY OF THE INVENTION

Therefore, it is a principal object, feature, and/or advantage of the present invention to provide a method and apparatus that overcomes the deficiencies in the art.

It is another object, feature, and/or advantage of the present invention to provide a method and apparatus for providing a direct contact icemaker to form ice in a mold.

It is another object, feature, and/or advantage of the present invention to provide a method and apparatus to cool air in an icemaker compartment and to direct the cooled air to an ice storage compartment.

It is another object, feature, and/or advantage of the present invention to provide a method and apparatus that provides a minimal amount of cold air to an ice bucket in an ice storage compartment to prevent ice cube melt.

Another further object, feature, and/or advantage of the present invention to provide a method and apparatus that re-circulates air in the ice making compartment and ice storage compartment for cooling the ice storage compartment.

Yet another object, feature, and/or advantage of the present invention to provide a method and apparatus that prevents ice from melting using low energy.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a refrigerator cabinet, a fresh food compartment disposed within the refrigerator cabinet, at least one door providing access to the fresh food compartment, an ice making compartment in the refrigerator cabinet for making ice, an ice storage compartment, and a cold air loop. The ice making compartment includes an ice mold and a coolant loop adjacent the ice mold. The ice storage compartment is adjacent the ice making compartment. The cold air loop is used for cooling air for the ice storage compartment, and includes a plurality of fins positioned on the coolant loop, and a fan assembly adjacent the fins such that the fan assembly can direct cooled air to the ice storage compartment.

According to another aspect of the present invention, a direct contact ice making compartment is provided. The compartment includes an ice mold, a water supply, a coolant loop, an ice storage compartment, and a cold air loop. The coolant loop is adjacent to and in contact with the ice mold. The cold air loop is adjacent the coolant loop and includes a plurality of fins positioned on the loop, and a fan assembly adjacent the fins such that the fan assembly directs cooled air to the ice storage compartment.

According to yet another aspect of the present invention, a method of providing re-circulated cooled air for an ice storage container in a direct contact ice making compartment is provided. The method includes providing a direct contact ice making compartment including an ice mold, a water supply, a coolant loop adjacent to and in contact with the ice mold, an ice storage compartment adjacent the ice mold, and a cold air loop including a plurality of fins and a fan assembly adjacent the plurality of fins. A flow of coolant is provided through the coolant loop. Air adjacent the cold air loop is allowed to be cooled by the fins. The cooled air is directed from the cold air loop to the ice storage compartment. Warmed air is directed from the ice storage compartment to the cold air loop, wherein the warm air is re-cooled and redirected to the ice storage compartment.

DETAILED DESCRIPTION OF THE PREFERRED EMBODIMENTS

Figure 1:
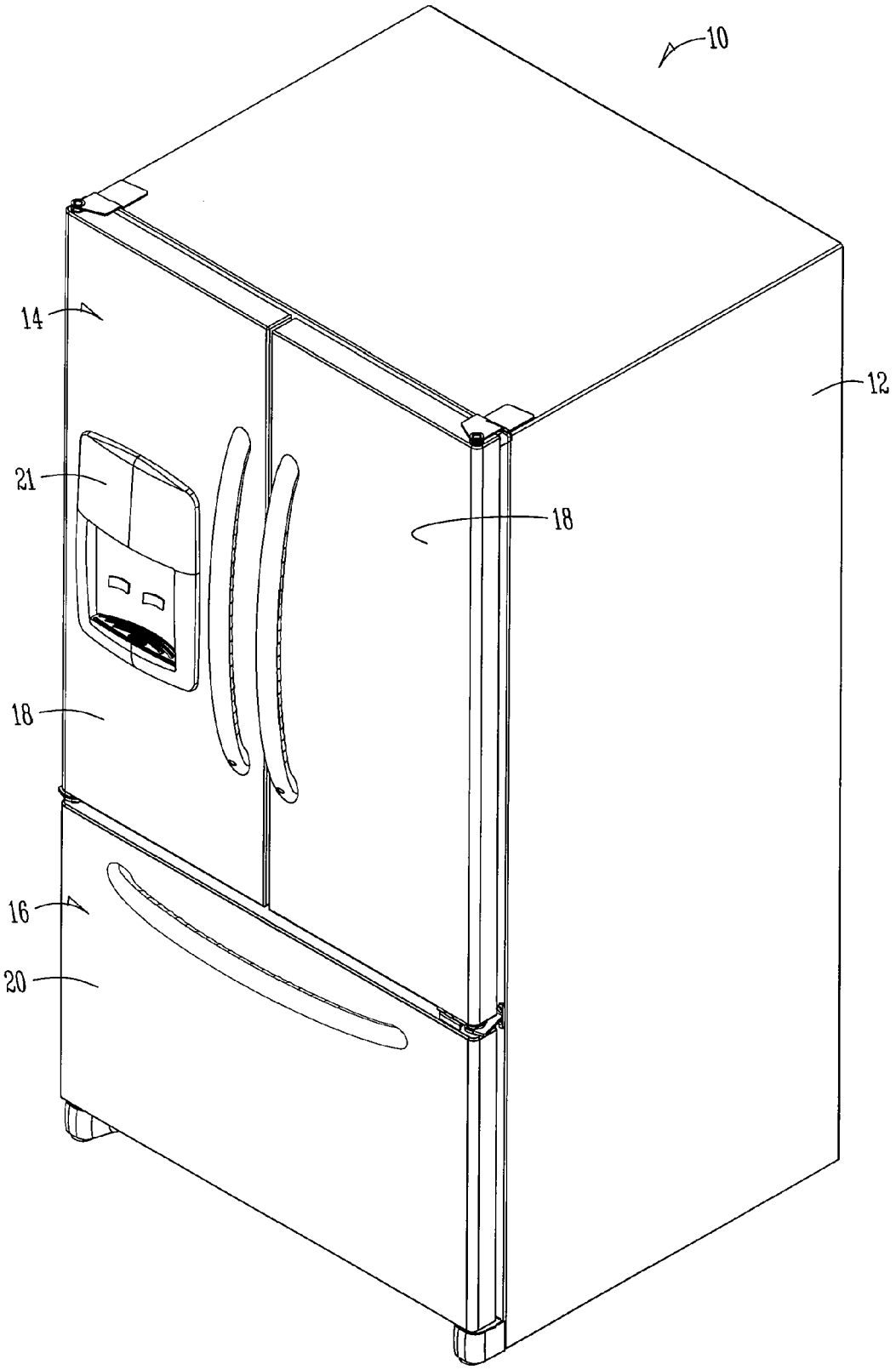
FIG. 1 is a perspective view showing one embodiment of a refrigerator having a direct contact ice making compartment.

FIG. 1 illustrates one embodiment of a refrigerator 10. The refrigerator 10 includes a refrigerator housing or cabinet 12. Two fresh food doors 18 provide access to a fresh food compartment 14. While two doors are shown, it should be appreciated that only one is needed for the present invention. A freezer door 20 provides access to a freezer compartment 16. The refrigerator 10 is shown in a bottom out configuration that the freezer compartment 16 is positioned below the fresh food compartment 14. An ice and water dispenser 21 is positioned on one of the fresh food compartment doors 18. Note that the ice and water dispenser 21 is positioned remotely from the freezer compartment 16. While this particular configuration of the refrigerator 10 is shown in FIG. 1, it should be appreciated that other types of refrigerators may be used with the present invention.

Figure 2:
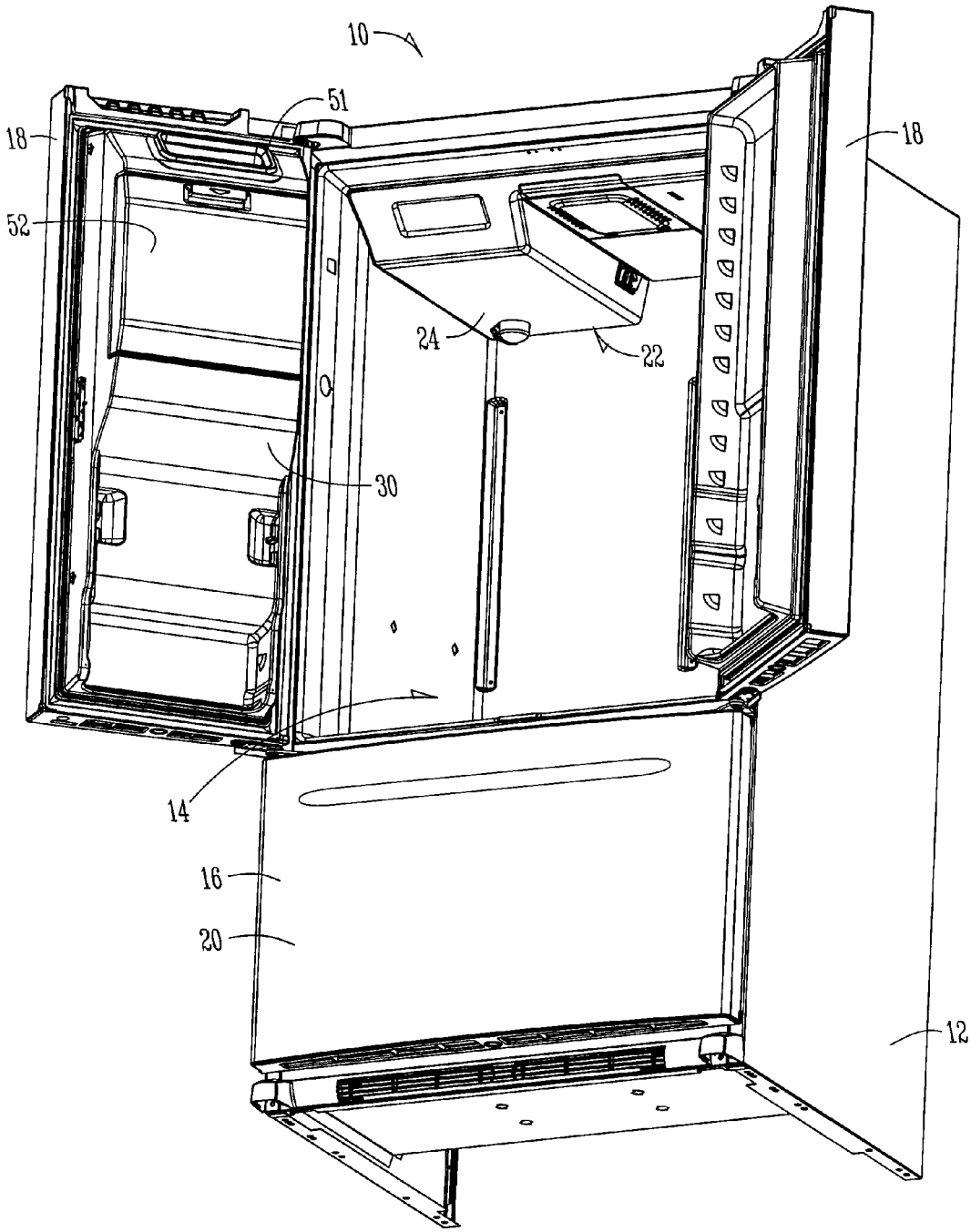
FIG. 2 is a perspective view of the refrigerator of FIG. 1 with doors open and showing the ice making compartment and ice storage compartment.

FIG. 2 illustrates the refrigerator 10 of FIG. 1 with the fresh food doors 18 in open positions. An ice making compartment 22 is shown positioned within the fresh food compartment 14, and adjacent one of the fresh food doors 18. An ice storage compartment 30 is provided adjacent to the ice making compartment 22 on one of the fresh food doors 18. The ice storage compartment may include a removable ice bucket 52, and the compartment 30 is used to store formed ice cubes.

FIGS. 3-8 show different views of an ice making system 24 of the present invention. The ice making system 24 is a direct contact ice making system and includes ice molds 26, a coolant loop 28, a cold air loop 32, a fan or fan assembly 36, a supply duct 38, and a return duct 40. The coolant loop 28 is in direct contact with the ice mold 26. The coolant loop is comprised of a conduit or line 64, and generally has a refrigerant or other coolant pasting through it. A water supply 54 is used to supply water to the ice mold 26 until the mold is filled to a predetermined level with water. Thereafter, a coolant passes through the line 64, which is connected to the coolant loop 28 in contact with the ice mold 26. The coolant going through the coolant loop 28 removes heat from the water in the ice mold 26, causing the water in the molds to dip to a temperature below freezing. This forms ice cubes 66 in the ice mold 26. While the term "ice cubes" is used in this invention, it should be appreciated that the ice may be in shapes other than cubes, and the term "cubes" is a term generally used in the art to describe frozen water.

A cold air loop 32 is provided in the ice making system 24 of the present invention. The cold air loop is located adjacent the ice mold 26 and includes a coolant line running through a plurality of fins 34. The coolant line may be a portion of the same line 64 that forms the coolant loop 28. The plurality of fins 34 may generally be made of a metallic or other heat exchanging material and is used to increase the surface area of the cold air loop 32 such that the area around the plurality of fins 34 is able to be cooled by coolant passing through the cold air loop 32. The number of fins may vary depending on the amount of space available in the cold air loop 32, but it should be noted that the purpose of the fins 34 is to cool ambient air within and around the fins 34 by removing heat from the air in the area of the cold air loop 32. This is generally known as a heat exchanging area or heat exchange zone 62. The coolant passing through the cold air loop 32 is in direct contact with the fins 34, creating a larger area of material that is able to remove heat from the air adjacent the fins 34 in the cold air loop 32, thus producing cooled air 48.

Adjacent to one side of the area including the fins 34 is a fan or fan assembly 36. The fan assembly 36 may include a fan and a motor. The fan and motor of the fan assembly 36 are used to direct the cooled air 48 from the area around the cold air loop 32 through a supply duct 38 to the ice storage container 30. The supply duct 38 is connected to the fan assembly 36 such that the fan assembly passes air directly through the supply duct. The supply duct has an opening adjacent the ice storage compartment 30 when the door 18 of the fresh food compartment is closed. The cooled air 48 in the cold air loop 32 is directed to the ice storage compartment 30 to maintain the ice cubes 66 in the storage compartment 30 at a desired temperature. The ice cubes 66 should be maintained at a temperature that prevents them from melting.

Figure 3:
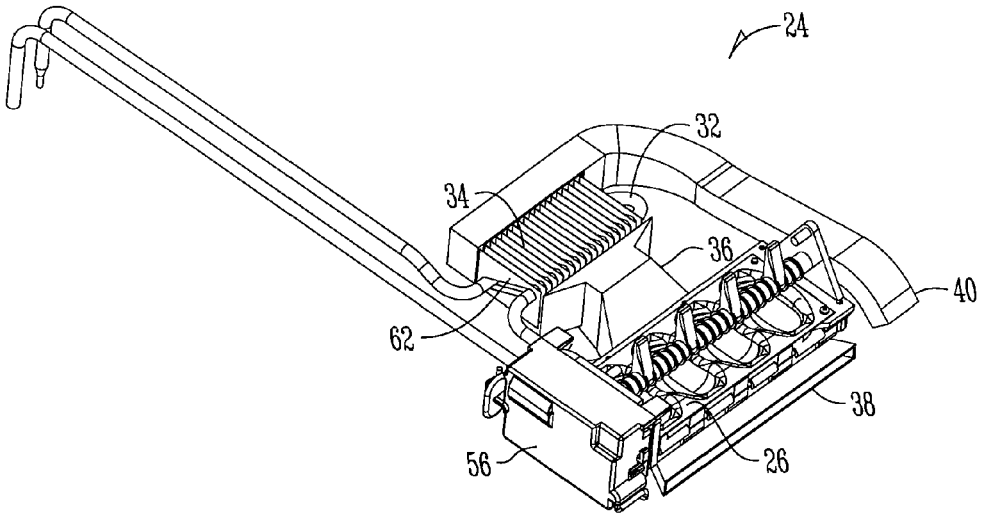
FIG. 3 is a top perspective view of an ice making system of the present invention.
Figure 4:
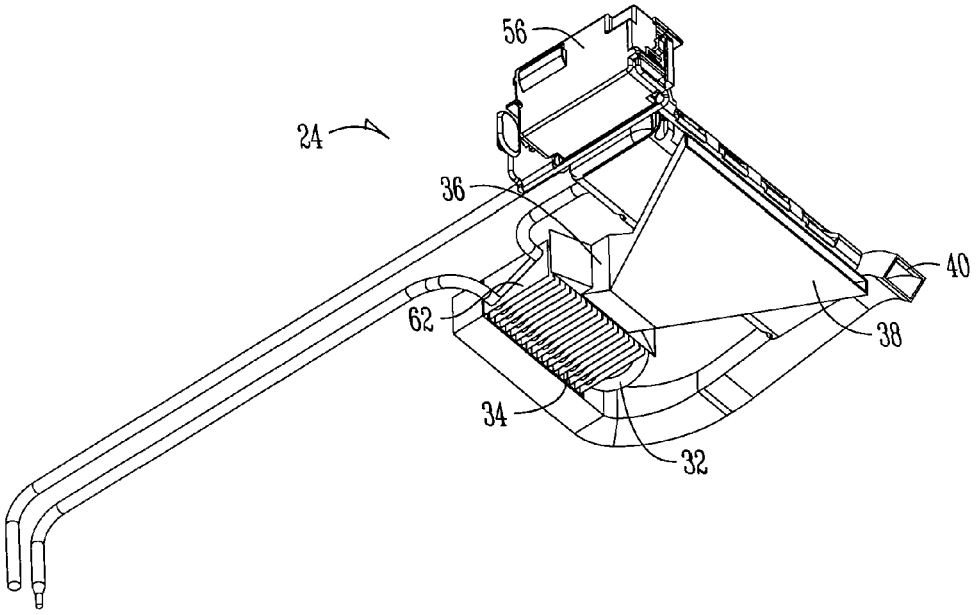
FIG. 4 is a bottom perspective view of the ice making system of FIG. 3.
Figure 5:
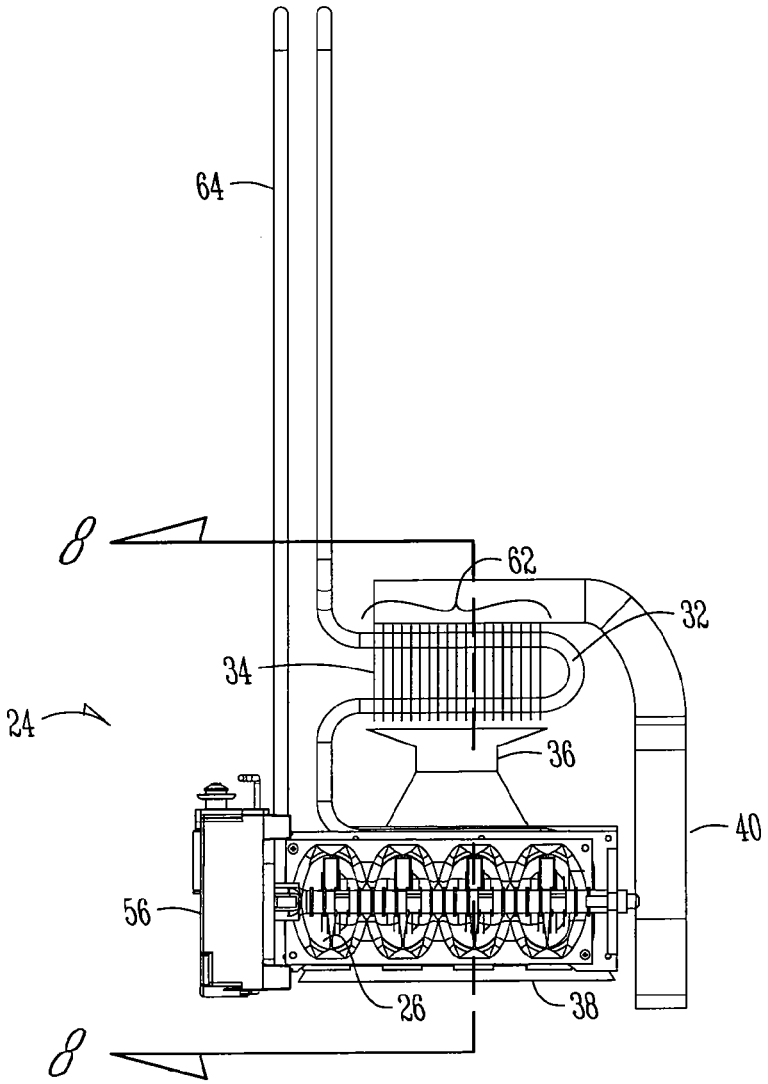
FIG. 5 is a top view of the ice making system of FIG. 3.
Figure 6:
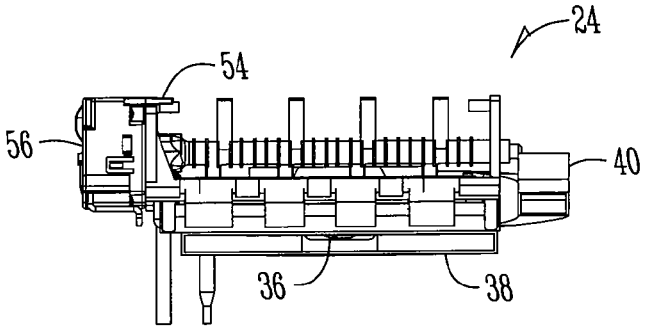
FIG. 6 is a front view of the ice making system of FIG. 3.
Figure 7:
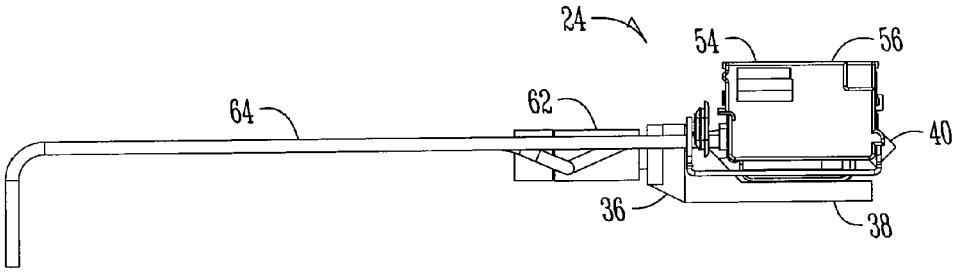
FIG. 7 is a side view of the ice making system of FIG. 3.
Figure 8:
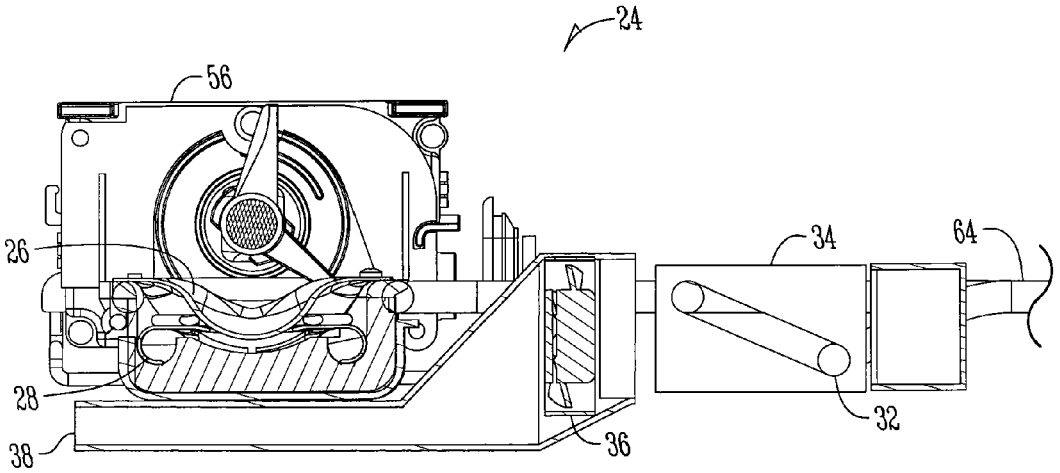
FIG. 8 is an enlarged sectional view of the ice making system according to line 8-8 of FIG. 5.

As shown in FIGS. 3 and 4, a return duct 40 is included in the ice making system 24 adjacent the supply duct 38. The return duct is used to direct air from the ice storage compartment 30 to the fins comprising the heat exchange zone 62 of the cold air loop 32. The cooled air 48 that has been passed into the ice storage compartment 30 removes heat from the ice cubes 66 to prevent them from melting. The air is then warmed, and should be removed from the ice storage compartment 30. This warmed air 50 is directed through the return duct 42 to the heat exchange zone 62, where it is cooled and redirected through the fan assembly 36 and supply duct 38 to the ice storage compartment 30.

Finally, a intelligent control 56 and water supply 54 is also included with the ice making system 24. The intelligent control includes a processor, which controls operation of the fan assembly 36 and the water supply 54. The intelligent control 56 turns on the water supply 54 to fill the ice mold 26 with water to form the ice. The intelligent control 56 also controls the operation of the fan assembly to control the flow of cooled air 48 from the heat exchange zone 62 to the ice storage compartment 30. When a fresh food door 18 is open, the intelligent control 56 will stop operation of the fan assembly 36 so that the fan assembly is not directing cooled air 48 from the cold air loop 32 to outside the refrigerator 10, for instance. It should also be noted that the intelligent control 56 may be used to direct operation of the arm 68 used in conjunction with ice mold 26 to remove the ice cubes 66 from the ice mold 26 when the water has frozen in the ice mold.

Figure 9:
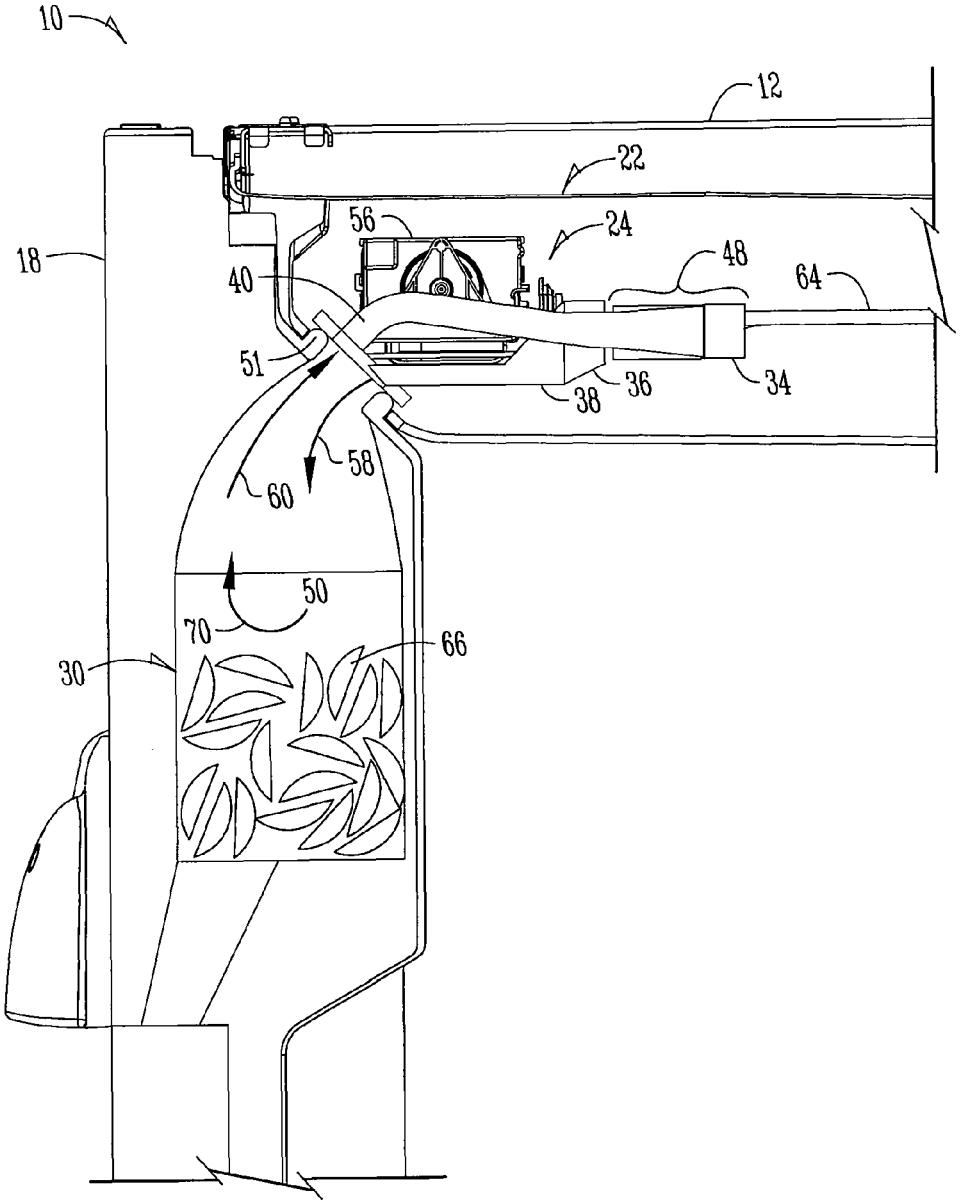
FIG. 9 is a view of the method of cooling the ice in the ice storage compartment according to an embodiment of the present invention.

FIG. 9 shows a structure for performing a method for producing cooled air to cool ice in an ice storage compartment 30 according to an embodiment of the present invention. The refrigerator 10 of FIG. 9 includes the ice maker compartment 22 in the cabinet or housing 12 of the refrigerator. The ice maker compartment includes the ice making system 24, as described above. Water is added to the ice mold 26, frozen, and ejected into the ice storage compartment 30. As shown in FIG. 9, a plurality of ice cubes 66 is shown in the ice storage compartment 30. To maintain the ice cubes 66 in the ice storage compartment 30 at an appropriate temperature, the method of using the present invention is provided.

A coolant or refrigerant is passed through the conduit line 64 to be used to cool the water in the ice mold 26. The coolant then passes through the cold air loop 32, which is surrounded by a plurality of fins 34. The fins and coolant line remove heat from ambient air surrounding the fins in the cold air loop to produce cooled air 48. The cooled air 48 is then directed by the fan assembly 36 through the supply duct 38 as shown by the arrow 58 of FIG. 9. The arrow 58 shows that the cooled air 48 is then passed over the ice cubes 66 stored in the ice storage compartment 30, to prevent the ice cubes from melting. The passing air is shown by the arrow 70 within the ice storage compartment and removes heat from the ice cubes in the compartment. This produces warmed air 50 in the ice storage compartment. The warmed air 50 should be removed. Therefore, the fan assembly also works to direct the warmed air 50 in the direction of the arrow 60 back through the return duct 40. The warmed air 50 is directed to the heat exchange zone 62 of the cold air loop 32, where it is re-cooled and recirculated through the supply duct into the ice storage compartment 30. Therefore, the air is recirculated to be cooled at the cold air loop and warmed in the ice storage compartment. This recirculation of air provides an efficient way to keep the ice cubes 66 in the ice storage compartment 30 at a desired temperature.

Figure 10:
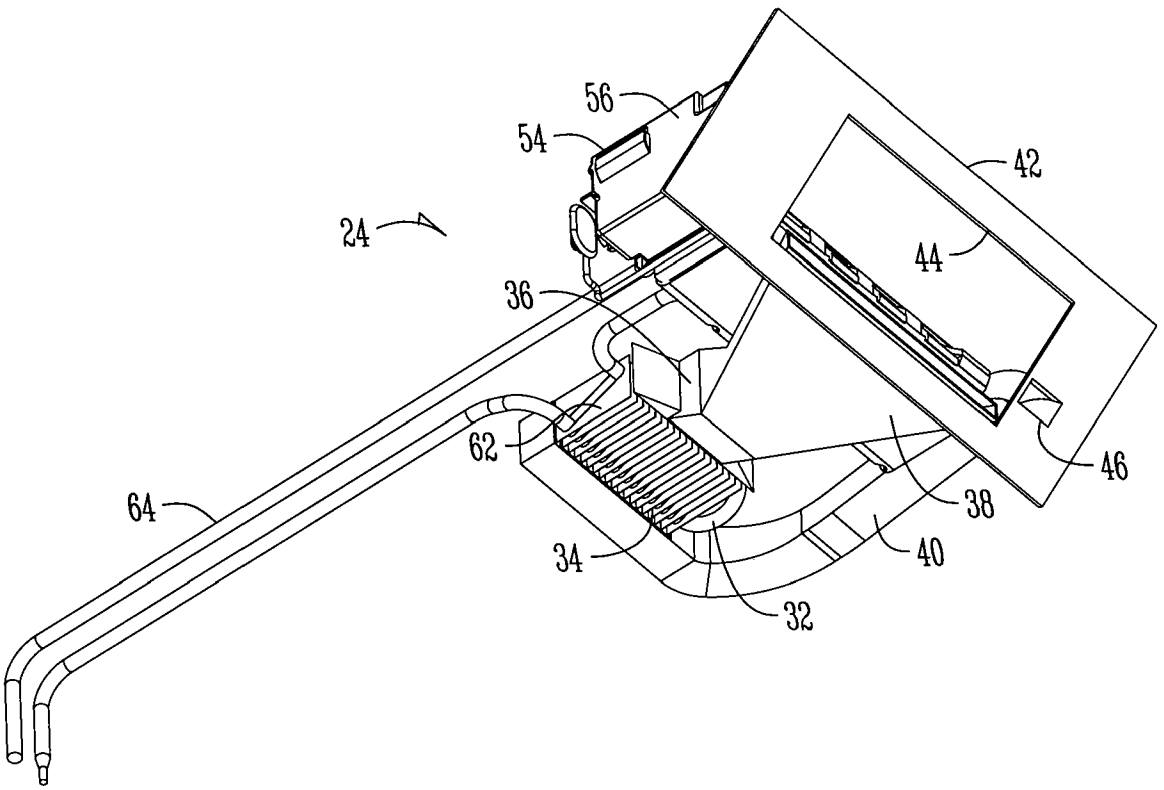
FIG. 10 is a perspective view of an ice making system according to an embodiment of the present invention.

FIG. 10 is perspective of a direct contact ice making system 24 according to another embodiment of the present invention. The ice making system 24 shown in FIG. 10 includes an ice maker cover plate 42 adjacent the ice mold 26 and supply duct 38. The cover plate 42 includes a supply aperture 44 and a return aperture 46. The supply aperture is used to direct the ice cubes 66 and cooled air 48 from the ice making system 24 to the ice storage compartment 30. The return aperture 46 is used in conjunction with the return duct 40 to direct warmed air from the ice storage compartment 30 to the cold air loop 32 for re-cooling of the air. The ice maker cover plate 42 may be included with the ice making system 24 to increase the efficiency of the system by limiting the amount of area the cooled air 48 needs to pass through. The decreased area causes the air to not disburse and be directed right into the ice storage compartment 30. The ice maker cover plate 42 may also be provided to provide a passageway for the ice cubes 66 to pass from the ice mold 26 to the ice storage compartment 30. As further shown in FIG. 10, the angle that the ice maker cover plate 42 is attached to the ice making system 24 is generally equal to the angle of the opening in the ice storage compartment 30 on the fresh food door 18. The supply aperture 44 and return aperture 46 should be within the extent of a seal 51 (see FIG. 2) provided on the ice storage compartment 30 to prevent air from leaking into the fresh food compartment. Alternatively, the seal could be provided on the ice maker cover plate 42.

The description of disclosure is merely exemplary in nature and, thus, contemplates numerous variations, options, and alternatives. For example, variations in a configuration of the refrigerator, variations in the type of ice making system, variations in the configuration of the cold air loop, configurations in the manner of ice storage, variations in the fan assembly, and other variations, options, and alternatives are within the spirit and scope of the invention.

What is claimed is:

1. A refrigerator, comprising:

a refrigerator cabinet;

a fresh food compartment disposed within the refrigerator cabinet;

at least one door providing access to the fresh food compartment;

an ice making compartment in the fresh food compartment for making ice and comprising an ice mold, a supply duct, a return duct, and a liquid coolant loop in direct contact with the ice mold;

an ice storage compartment on the fresh food compartment door adjacent to the ice making compartment, comprising an aperture for receiving one or more harvested ice cubes disposed adjacent the exit aperture;

a cold air loop positioned in the ice making compartment for cooling air for the ice storage compartment, the cold air loop including a plurality of fins positioned on the liquid coolant loop, a fan assembly adjacent to the fins to direct cooled air via the supply duct to the ice storage compartment and back to the fins from the ice storage compartment via the return duct, wherein the supply duct and the return duct and the ice storage compartment are isolated from the ice mold; and wherein the cold air loop is substantially between the plurality of fins and the ice storage compartment, wherein at least one of the plurality of fins is in communication with the ice making compartment for cooling air in the ice making compartment, and further wherein a portion of the liquid coolant loop adjacent the fan assembly passes through the plurality of fins and the ice mold.

2. The refrigerator of claim 1 wherein the return duct comprises a first end adjacent the ice storage compartment aperture for returning air from the ice compartment to the cold air loop.

3. The refrigerator of claim 2 further comprising an icemaker cover plate operably connected to the ice making compartment such that the icemaker cover plate is adjacent the ice storage compartment in an ice making process.

4. The refrigerator of claim 3 wherein the icemaker plate comprises a supply aperture and a return aperture.

5. The refrigerator of claim 1 wherein the cooled air directed through the supply aperture causes the air within the ice storage compartment to be directed to the return duct and back to the cold air loop.

6. The refrigerator of claim 1 wherein the ice storage compartment comprises a removable ice bucket contained within the ice storage compartment.

7. A direct contact ice making system comprising:

an ice mold disposed in a refrigerated compartment of a refrigerator;

a water supply;

a coolant loop adjacent to and in direct contact with the ice mold and a plurality of fins;

an ice storage compartment disposed on a door of the refrigerator and adjacent to the ice mold comprising an aperture for receiving one or more harvested ice cubes from the ice mold;

a cold air loop comprising:

the plurality of fins positioned on the coolant loop;

a supply duct with a first end adjacent to the ice storage compartment aperture to supply cooled air to the ice storage compartment and a second end adjacent the plurality of fins;

a return duct with a first end adjacent to the ice storage compartment aperture to return warm air from the ice storage compartment and a second end adjacent the plurality of fins;

a fan assembly adjacent the plurality of fins and substantially between the plurality of fins and the ice storage compartment to direct the cooled air to the ice storage compartment;

wherein the second end of the supply duct and the second end of the return duct proximate to the plurality of fins are positioned on opposing sides of the plurality of fins; and wherein the cold air loop is isolated from the ice mold and disposed substantially between the plurality of fins and the ice storage compartment and wherein at least a portion of cold air in the cold air loop is drawn into the cold air loop through the plurality of fins.

8. The system of claim 7 further comprising an intelligent control adjacent the fan assembly and configured to selectively turn the fan on and off.

9. The system of claim 8 wherein the plurality of fins is positioned between at least a portion of the supply duct and a portion of the return duct.

10. The system of claim 7 wherein the ice storage compartment includes a removable ice bucket contained within the ice storage compartment.

11. A method of providing re-circulated cooled air for an ice storage compartment in a direct contact ice making compartment, the method comprising:

providing a direct contact ice making compartment in a refrigerated compartment of a refrigerator and including an ice mold, a water supply, a liquid coolant loop adjacent to and in contact with the ice mold, an ice storage compartment disposed on a door of the refrigerator and adjacent the ice mold, and a cold air loop including a plurality of fins and a fan assembly, the cold air loop disposed closely adjacent the ice mold, the plurality of fins and the coolant loop;

circulating a flow of liquid coolant through the liquid coolant loop, wherein the same flow of liquid coolant directly contacts and cools both the plurality of fins and the ice mold;

cooling air adjacent to the plurality of fins in the cold air loop by urging air through the plurality of fins;

forcing the cooled air from the plurality of fins closely adjacent to but free of contact with the ice mold into the ice storage compartment via a supply duct to a supply aperture in the ice making compartment; and forcing warm air from the ice storage compartment via a return duct to the plurality of fins, wherein the warm air is re-cooled and redirected to the ice storage compartment in the cold air loop.

12. The method of claim 11 further comprising providing the ice making compartment with a supply duct and a return duct.

13. The method of claim 12 further comprising directing cooled air through the supply duct to the ice storage compartment and directing warm air through the return duct to the cold air loop to be re-cooled.

14. The method of claim 11 wherein the ice making compartment further includes an intelligent control to control operation of the fan assembly.

15. The method of claim 14, wherein the fan assembly is disposed adjacent the plurality of fins, and between the fins and the ice storage compartment.

* * * * *